US005496184A

United States Patent [19]

Garrett et al.

[11] Patent Number: 5,496,184

[45] Date of Patent: Mar. 5, 1996

[54] HEADER ASSEMBLY FOR PRINTED CIRCUIT BOARD

[75] Inventors: Roger L. Garrett, New Wilmington, Pa.; Bruce J. Serbin, Canfield; Randy L. Fink, Warren, both of Ohio

[73] Assignee: General Motors Corporation, Detroit, Mich.

[21] Appl. No.: 270,975

[22] Filed: Jul. 5, 1994

[51] Int. Cl.[6] ..... H01R 13/422; H01R 23/70

[52] U.S. Cl. ..... 439/79; 439/595; 439/701

[58] Field of Search ..... 439/79, 532, 540.1, 439/701, 595

[56] References Cited

U.S. PATENT DOCUMENTS

| | | | |
|---|---|---|---|
| 4,484,792 | 11/1984 | Tengler et al. | 439/701 |
| 4,998,896 | 3/1991 | Lundergan | 439/595 |
| 5,108,309 | 4/1992 | Oda et al. | 439/595 |
| 5,161,997 | 11/1992 | Defibaugh et al. | 439/540.1 |

*Primary Examiner*—Gary F. Paumen
*Attorney, Agent, or Firm*—William A. Schuetz

[57] ABSTRACT

A compact header assembly for connection to a printed circuit board comprises a header housing 20 having a central through opening 22, a pin terminal and carrier strip assembly 24 having a carrier strip 26 which is slidably connected to the header housing 20 via a rail and groove connection and which carries a plurality of pin terminals 28 which are connected to the circuit traces 14, 15 of the printed circuit board 12 and a preassembled wiring harness connector subassembly 30 having a retainer housing 32, a connector body 34 which is connected to the retainer housing 32 and which carries a plurality of female socket terminals 36. The connector body 34 after the terminals 36 are positioned therein is slidably connected to the retainer housing 32 and the retainer housing 32 in turn is then slidably connected into the central opening 22 of the header housing 20 and with the socket terminals 36 matingly engaging the pin terminals 28 when the connector subassembly 30 is connected to the header housing 20.

10 Claims, 4 Drawing Sheets

HEADER ASSEMBLY FOR PRINTED CIRCUIT BOARD

The present invention relates to a header assembly for a printed circuit board and, more particularly, to a compact header assembly having a header housing to which a preassembled pin and carrier strip subassembly can be readily connected and to which a preassembled connector subassembly can be readily connected.

The present invention provides a novel header assembly for connecting one or more wiring harnesses to a printed circuit board or the like. The header assembly comprises a one piece thin walled zinc die cast header housing having a main housing portion provided with a central through opening, a side opening in communication with the central through opening at one end thereof and a mounting means located beneath the main housing portion for mounting the header housing to a printed circuit board. The header housing also includes a pair of spaced, linear rails at its end adjacent the side opening. The header assembly further includes a preassembled pin terminal and carrier assembly comprising an elongated plastic carrier strip having a plurality of openings therethrough and a plurality of pin terminals inserted through the openings in the carrier strip and retained in the strip so that its forward and rearward end portions extend outwardly of the carrier strip. The carrier strip additionally has grooves along its opposite sides for receiving the rails on the header housing when the pin terminal and carrier strip is inserted through the side opening in the header housing and then slid entirely across the transverse extent of the header housing. When the pin terminal and carrier strip is slidably connected to the header housing, the pin terminals thereof are all located within the central through opening of the header housing.

The header assembly further includes a preassembled connector subassembly for connecting a wiring harness to the pin terminals in the header housing. The connector subassembly includes a retainer housing having a central opening, a connector body having a plurality of axially extending cavities extending therethrough and a plurality of metal socket terminals retained within the cavities of the connector body. The metal socket terminals have a pair of spaced lands defining a recess therebetween and the connector body is slit to define outer wall portions having radially inwardly extending nibs and radially outwardly extending tabs. The socket terminals when connected to the connector body engage the nibs of the wall portion to deflect the same radially outwardly until the nibs clear the forwardmost land of the terminal and thereafter the wall portions return to their normal free state position to position the nibs between the lands to lock the terminals in place. If one of the socket terminals is not properly positioned within the connector body, the adjacent radially outwardly extending tab will extend further outwardly to provide a visual signal that the terminal has not been properly seated within the connector body. When the terminals are seated within the connector body, the connector body can be connected to the retainer housing by inserting the connector body within the central opening in the retainer housing. If any of the terminals are not properly seated within the connector body, the tab will engage the end of the retainer housing and prevent connection of the connector body to the retainer housing. This provides a second check to make sure that all the terminals have been properly seated in the connector body. The retainer housing and the connector body have cooperable latching elements to connect the same together.

The retainer housing is connected to the header housing by inserting the same into the central through opening of the header housing, the retainer housing having aligned openings at its forward end to allow mating engagement between the socket terminals carried by the connector body and the pin terminals carried by the carrier strip. The retainer housing has vertical guides at its opposite lateral sides which are slidably received within recesses in the connector housing to connect the same to the header housing so that it cannot pivot relative to the header housing. In addition, the header housing and the retainer housing have cooperable latching elements to connect the two together.

In addition, a connector position assurance (CPA) can be provided to ensure that the retainer housing has been properly connected to the header housing and to prevent disconnection therebetween without manual manipulation of the connector position assurance.

Some of the advantages of the novel compact header assembly are that the zinc die cast housing provides a thin walled housing resistant to flex. The mounting features for the assembly are all located beneath the zinc die cast header housing to permit uninterrupted placement of conductors along a circuit board and to provide for more efficient utilization of the printed circuit board layout or footprint. The use of the pin carrier strip with its rail and groove or tongue and groove connection with the header housing provides for a fast assembly and enables the pin terminals all to be preassembled on assembly equipment prior to being placed in the header housing. The vertical side guides on the retainer housing when slidably connected to the header housing prevents the wiring harness connector subassembly from pivoting relative to the header housing and provides for a more stable positioning thereof.

In addition, an improved lock is provided for the terminals in the connector body by splitting the outer wall of the latter so that the nibs can be deflected and then flexed back and be received between the lands on the terminal to positively lock the terminal in place. Further, the outer tabs on the connector body are received in axial slots in the retainer housing when the terminals are properly connected. If the terminals are not properly connected, the tabs will not be received within the slots and thus a positive signal that the terminals have not been properly positioned is provided. Also, if the terminals are properly positioned and the tabs are received within the slot in the retainer housing, they will then pass freely into the header housing when the retainer housing is connected thereto. The terminals in the connector housing cannot be reversely moved out of their cavities due to the fact that the deflectable wall portions will have the tab thereof engage the header housing to prevent any such reverse movement.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
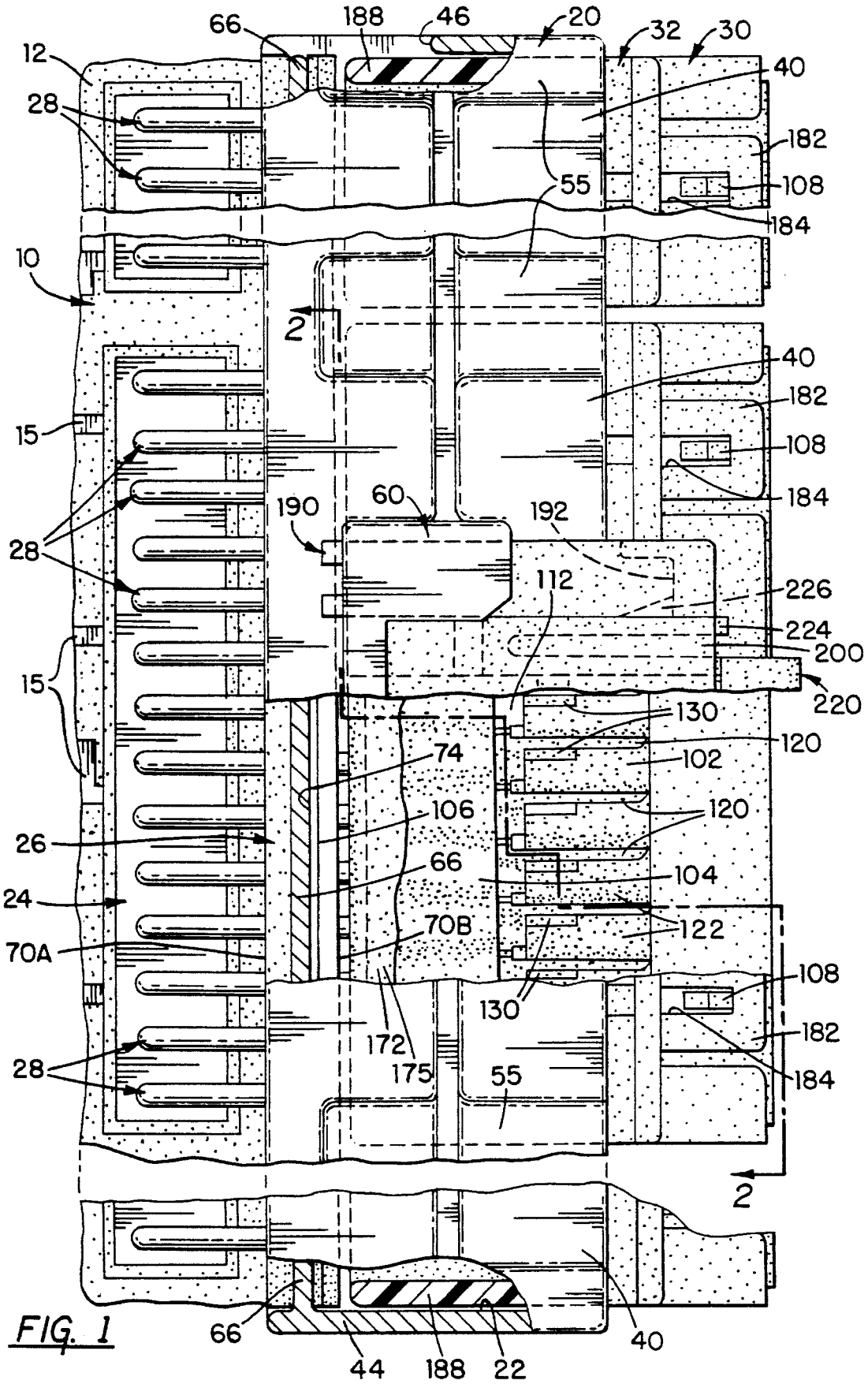
FIG. 1 is a fragmentary, top plan view with portions shown in section of the novel header assembly of the present invention.
Figure 2:
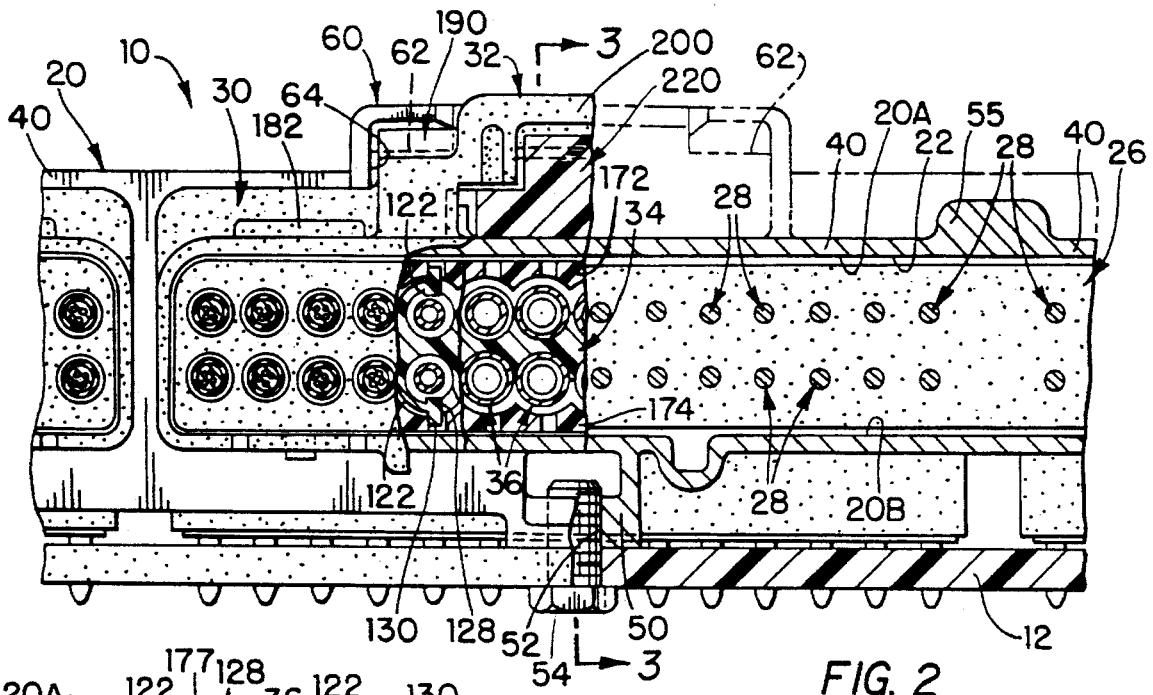
FIG. 2 is a fragmentary sectional view taken approximately along line 2–2 of FIG. 1.
Figure 4:
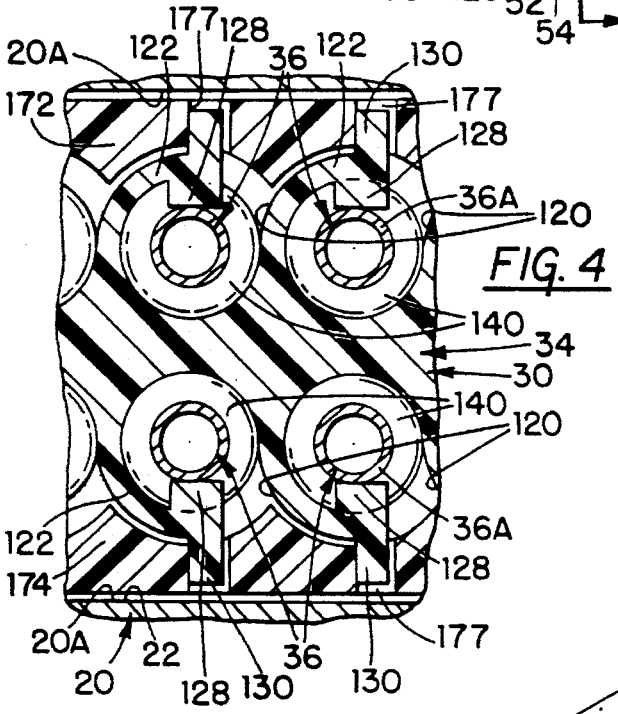
FIG. 4 is an enlarged, fragmentary sectional view taken approximately along lines 4–4 of FIG. 3.

In accordance with the provisions of the present invention, a novel header assembly 10 is provided for connection to a printed circuit board 12. The printed circuit board 12 could be of any suitable or conventional construction, but is preferably a rigid planar circuit board made from a suitable electrically insulated material and which has a plurality of printed circuit lines or traces 14, 15 located on its bottom and upper sides (see FIG. 3).

The novel header assembly 10 comprises, in general, a header housing 20 having a central through opening 22, a pin terminal and carrier strip assembly 24 having a carrier strip 26 which is slidably connected to the header housing 20 and which carries a plurality of pin terminals 28 which are connected to the circuit traces 14, 15 of the printed circuit board 12 and a preassembled wiring harness connector subassembly 30 having a retainer housing 32, a connector body 34 which is connected to the retainer housing 32 and which carries a plurality of female socket terminals 36. The connector body 34 after the terminals 36 are positioned therein is slidably connected to the retainer housing 32 and the retainer housing 32 in turn is then slidably connected into the central opening 22 of the header housing 20 and with the socket terminals 36 matingly engaging the pin terminals 28 when the connector subassembly 30 is connected to the header housing 20.

The header housing 20 comprises a one piece, thin walled zinc die cast housing having a plurality of laterally spaced housing portions 40 (three housing portions in the illustrated embodiment), each provided with a central through opening 22 for receiving a preassembled wiring harness connector subassembly 30. The openings 22 of the housing portions 40 all communicate with a common opening 42 at one or the left end of the header housing 20 as viewed in FIGS. 1, 6 or 7. The opening 42 extends laterally across the entire header housing 20. The reason for the transversely extending opening 42 laterally across the entire end of the header housing 20 is so that a single carrier strip 26 can be employed and extended laterally across the entire header housing 20, and as will be described hereinafter. The opening portion 42 at one end of the header housing 20, as viewed in FIG. 1, is closed by an end wall 44. Opening 42 at the other end of the header housing communicates with a side opening 46, the latter opening 46 also communicating with the adjacent central through opening 22 of the adjacently located housing portion 40. The housing portions 40 are generally rectangular in shape and the opening portion 42 is also rectangular in shape.

Figure 3:
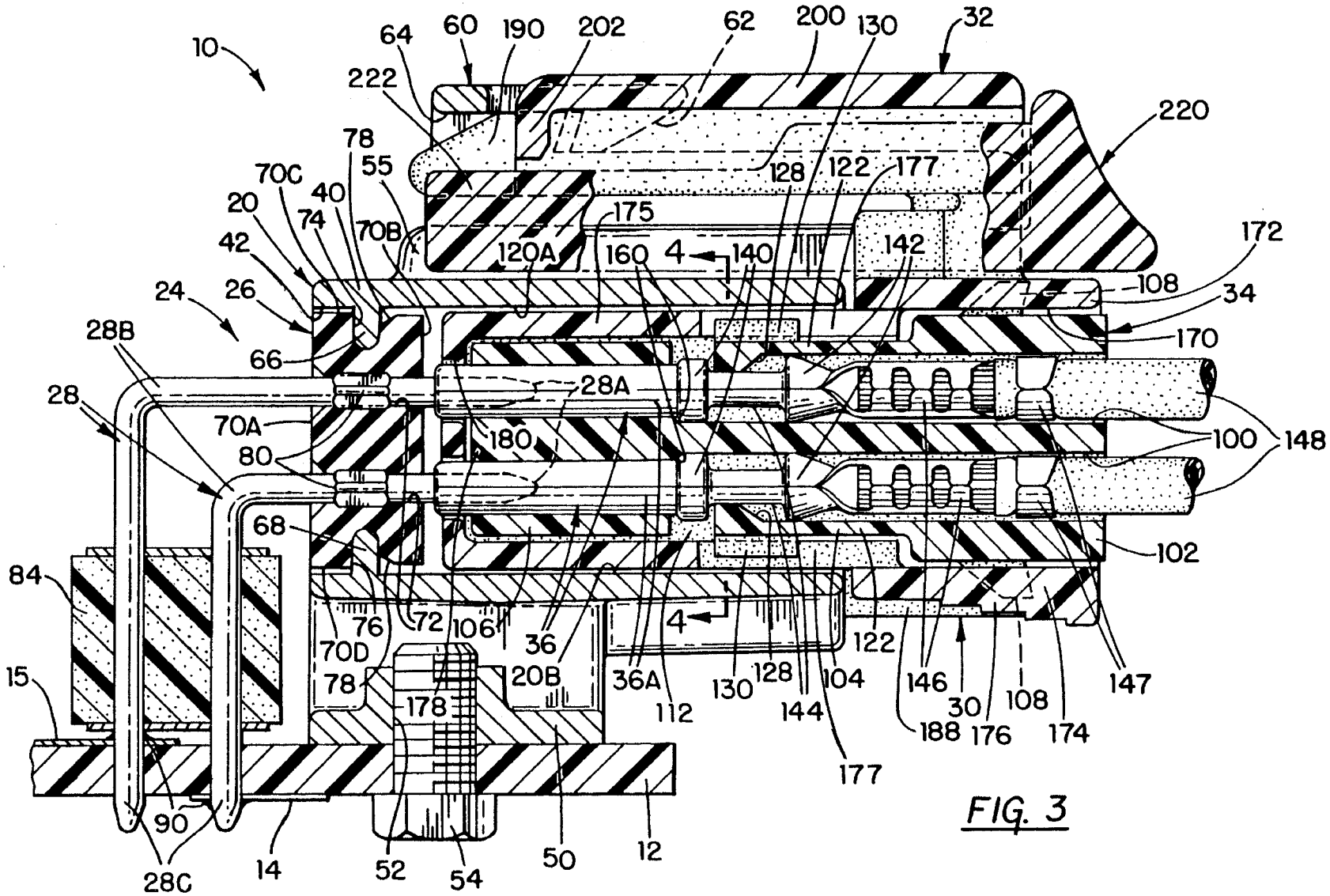
FIG. 3 is an enlarged, fragmentary sectional view taken approximately along lines 3–3 of FIG. 2.

The housing 20 at spaced transverse locations therealong has a plurality of depending feet 50 provided with threaded openings 52. The feet 50 are located directly beneath the rest of the housing 20 so that they don't take up any additional space on the printed circuit board 12 other than the space needed for the header housing 20. The feet 52 enable the header housing 20 to be secured to the printed circuit board 12 via threaded fasteners 54, as shown in FIG. 3. The header housing 20 adjacent the housing portions 40 has vertical bosses 55 which define vertical side walls 56 for the housing portions 40 and vertical slots 57 adjacent the sides 56 of the housing portions 40 for receipt of the retainer housings 32, and in a manner to be hereinafter more fully described. The housing portions 40 of the header housing 20 additionally have an inverted U-shaped latching portions 60 provided with a pair of downwardly extending barbed ramps 62 adjacent its forward end and located at its lateral sides, and for a reason to be hereinafter more fully described. The U-shaped portions 60 defines an axially extending passage 64 between the body portions 40 of the header housing 20 and the side walls and bight of the U-shaped portion 60.

The header housing 20 also includes a pair of rails 66, 68 extending perpendicularly inwardly into the common opening 42 along its top and bottom interior sides 20A and 20B, respectively. The rails 66, 68 are of a uniform thickness and have rounded or convex free ends, are located directly opposite each other in a facing manner and extend across the entire width of the header housing 20.

The pin terminal and carrier strip assembly 24 comprises a one piece plastic strip member 26 having a plurality of apertures 72 extending therethrough. The carrier strip 26 could be made from any suitable plastic material, but is preferably made from a polymer plastic material. The carrier strip 26 is rectangular in shape and shaped complementary with the common opening 42 in the header housing 20. The carrier strip 26 has planar front and rear sides 70A, 70B and has a pair of grooves 74, 76 extending inwardly from its top and bottom sides 70C, 70D which are shaped complementary with the rails 66, 68 of the header housing 20. The top and bottom sides of the carrier strip adjacent one side of the grooves 74, 76 are beveled, as indicated by reference numerals 78, to reduce the friction engagement between the sides 70C, 70D of the carrier strip 26 and the top and bottom walls 20A, 20B of the header housing 20.

Figure 5:
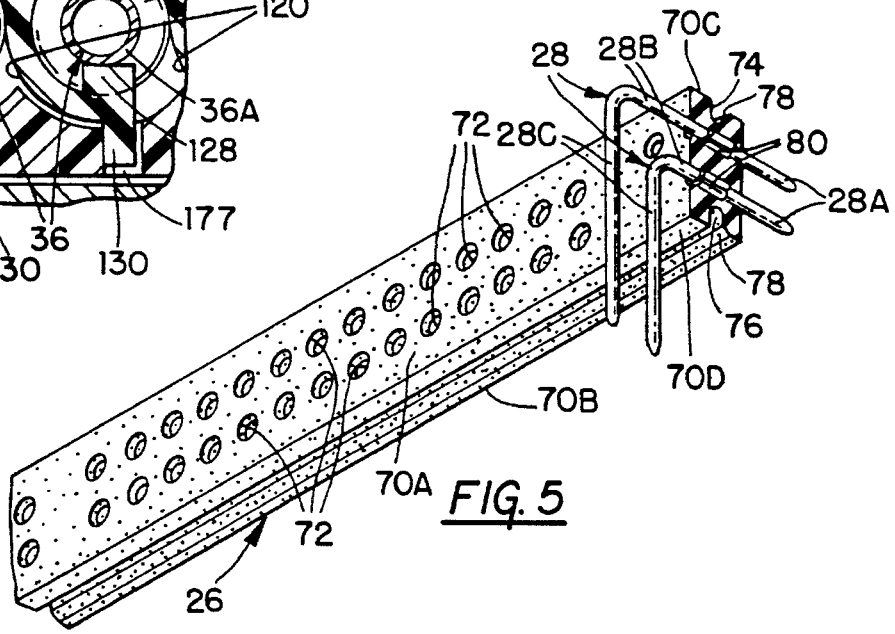
FIG. 5 is a fragmentary, perspective view of part of the header assembly shown in FIGS. 2 and 3.

The pin terminals 28 are metal cylindrical pins of a conventional construction and are bent at right angles, as shown in the drawings. The pin terminals 28 are cold upset intermediate their ends to provide cross shaped barbs 80. The pin terminals 28 are secured to the carrier strip 26 by pushing the pin terminals 28 into the openings 72 and with the barbs 80 tightly frictionally engaging the carrier strip as the pin terminals are inserted therein. The pin terminals 28 are all inserted into the carrier strip the same distance so as to have forward end portions 28A whose forwardmost ends are all located the same distance from the front face 70A of the carrier strip 26. The pin terminals are bent along the rearward portions 28B so that they have tail portions 28C which are at right angles to the forward portions 28A. In header assemblies where filtering is required, the pin terminals can also connected along their tail portions 28C to a suitable ferrite block 84, and in a manner well known to those skilled in the art. It should be noted that the openings 72 are beveled, as shown in FIG. 5, at the rearward end of the carrier strip 26 so as to aid in enabling the forward ends of the pin terminals 28A to be inserted into the openings 72.

The preassembled pin terminal and carrier strip assembly 24 is adapted to be connected to the header housing 20 by inserting the carrier strip 26 through the side opening 46 of the header housing 20 and in a manner such that the rails 66, 68 are slidably received in the grooves 74, 76, respectively. The preassembled pin terminal and carrier strip assembly 24 is then slid along the rails 66, 68 until the end of the carrier strip engages the end wall 44 of the header housing 20. The engagement between the carrier strip 26 and the rail 66, 68 is such that the carrier strip engages the rails with an interference fit so that a reasonably good seal is provided therebetween. When the carrier strip and pin terminal assembly 24 are connected to the header housing, an end cap (not shown) for closing off the side opening 46 can be attached to the header housing to completely enclose the carrier strip 26.

When the pin terminal and carrier strip assembly 24 is connected to a header housing 20, the header housing 20 can then be attached to the circuit board 12 via the fasteners 54. The tails 28C of the pin terminal 28 when connected to the circuit board 12 extends through openings in the circuit lines 14, 15 on the circuit board 12 and are suitably connected to the circuit lines via soldering, as indicated by reference numeral 90. The ferrite block 84 would be positioned above the printed circuit board 12 but spaced therefrom.

As noted before, the header assembly also includes preassembled wiring harness connector assemblies 30 for connection to the housing portions 40 of the header housing 20. Although the number of connector assemblies 30 would be dependent on the number of housing portions contained in the header housing 20, only one connector assembly 30 is shown in the drawings and it should be understood that the other connector assemblies would be of the same or very similar construction.

Figure 6:
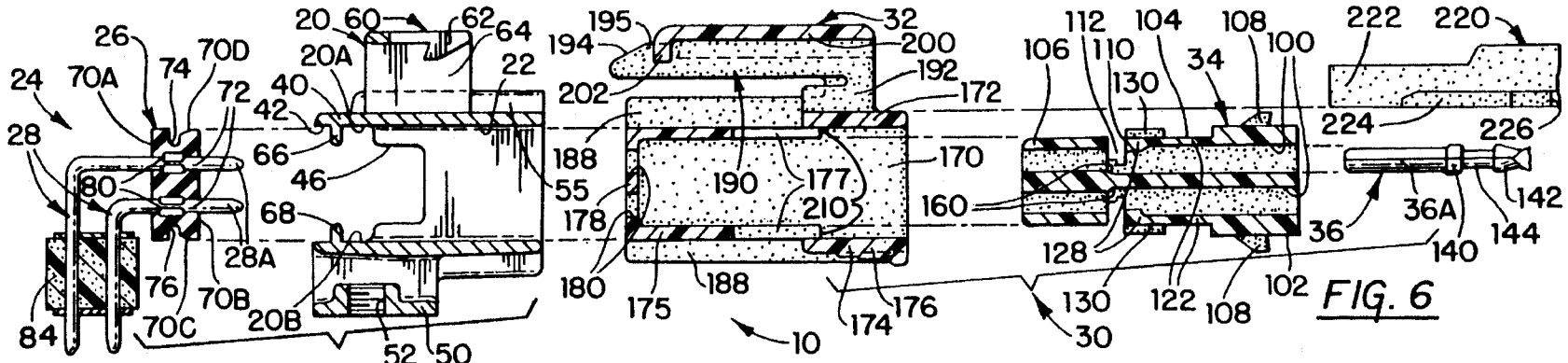
FIG. 6 is an exploded, side elevational view with parts shown in section of the header assembly shown in FIG. 1.
Figure 7:
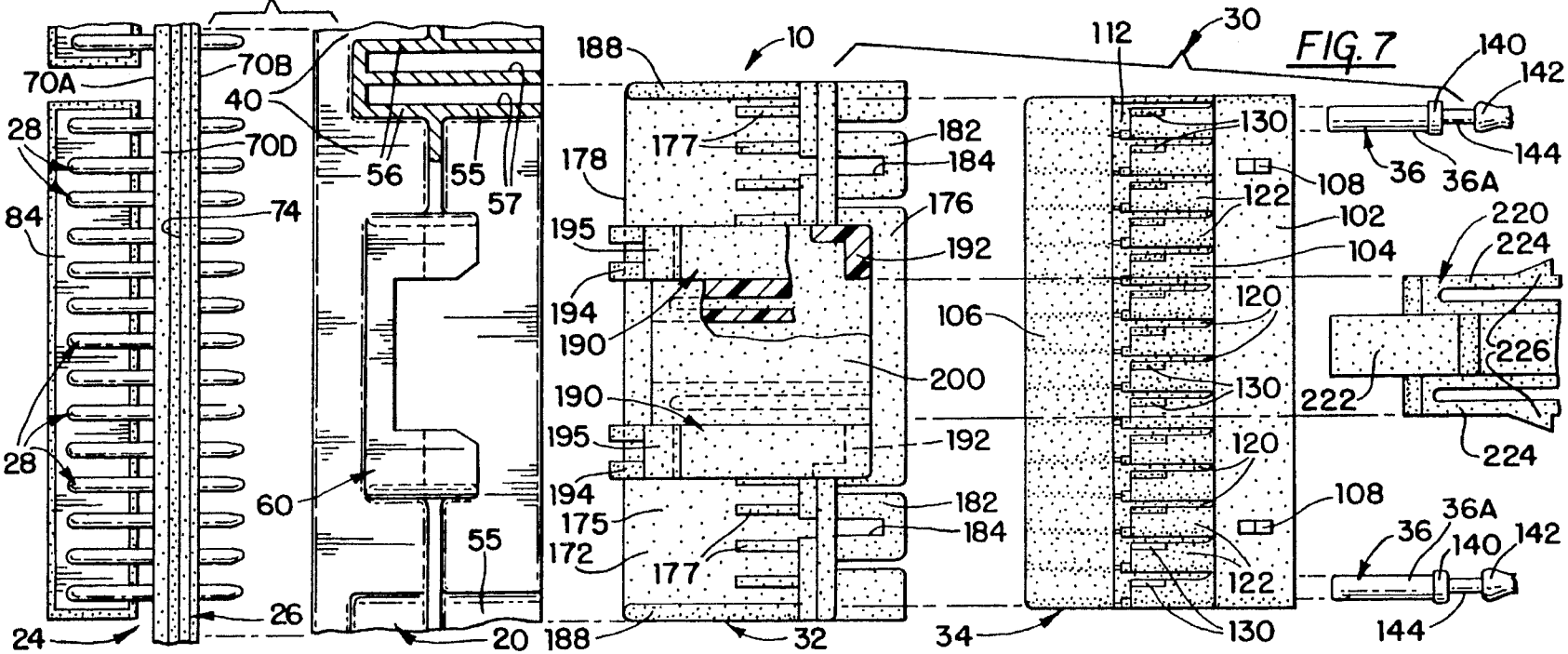
FIG. 7 is a fragmentary, exploded top elevational view with parts shown in section of the header assembly shown in FIG. 6.

The connector assembly 30 includes a plastic connector body 34 having a plurality of cavities 100 extending axially therethrough for receiving a plurality of metal socket terminals 36. As best shown in FIGS. 3, 6 and 7, the connector body 34 has a rearward portion 102, an intermediate portion 104 and a forward portion 106. The rearward portion 102 is generally rectangular in shape and has spaced ramped tabs 108 at its top and bottom sides. The rearward portion 102 is substantially rigid and provides a tunnel for receiving the metal socket terminals 36.

The forward portion 106 is also substantially rigid and is generally rectangular in shape and is aligned with the rearward portion 102 to provide for a continuation of the cavities 100. The forward portion 106 is of a slightly lesser height than the intermediate portion 104 or rearward portion 102, and for a reason to be hereinafter more fully described.

The intermediate portion 104 is integral with the rearward portion 102 at its right end, as viewed in FIG. 6, and is integral with the forward portion 106 along its central section, but has a left or forward end 110 at its outer sections which is spaced from the forward portion 106 to define a radially extending gap 112 surrounding the central section. The intermediate portion 104 at its outer walls adjacent the cavities 100 are also axially slit, as indicated by reference numeral 120, so as to define deflectable outer wall portions 122. The slits 120 at their forward end communicate with the gap 112. The wall portions 122 are integral with the central section along one side but spaced from the central portion adjacent its other axial side. The wall portions 122 have radially inwardly extending ramped nibs 128 which extend into the cavities 100 and have radially outwardly extending tabs 130 which extend outwardly from the top and bottom surfaces of the intermediate portion 104. The wall portions 122 are supported cantilever fashion and are radially deflectable relative to the cavities 100.

The connector body 34 receives and houses all of the mating socket terminals 36. The metal socket terminals 36 could be of any suitable or conventional construction provided that they have a pair of spaced lands. The socket terminals 36 will only be described herein to the extent necessary to understand the present invention. Each socket terminal 36 is of a two piece construction and comprises a forward hollow cylindrical portion 36A which is adapted to receive the forward portion 28A of the pin terminals 28 and includes a pair of spaced lands 140, 142 which define a recess 144 therebetween, as best shown in FIG. 3. The socket terminals 36 also include crimping flanges 146, 147 for crimping onto the bare ends of insulated wire conductors 148 and for crimping onto the insulated portions of the insulated wire conductors 148, respectively.

The socket terminals 36 are adapted to be connected to the connector body 34 by inserting the socket terminals into the connector body 34 from right to left, as viewed in FIGS. 3, 6 and 7 of the drawings. As each of the socket terminals 36 is inserted into one of the cavities 100, the forwardmost land 140 of the socket terminal 36 will engage the nib 128 of the adjacent wall portion 122 and cause the wall portion 122 to be deflected radially outwardly along a curved path. When the forwardmost land 140 moves past the nib 128, the inherent resiliency of the wall portion 122 will cause the same to return towards its normal free state position and the nib 128 to be received within the recess 144 between the lands 140, 142. The nib 128 locks the socket terminal 36 in place against rearward or rightward movement, as viewed in FIG. 3. In addition, the connector body 34 at the juncture of its forward end portion 106 and the central section of the intermediate portion 104 provides a transversely or radially extending stop surface 160 for engaging the land 140 so that the socket terminal 36 cannot be inserted through the connector body 34. The socket terminals 36 are thus locked against forward movement by the stop 160 and against rearward movement by the nibs 128.

The connector body 34 is adapted to be inserted and slidably connected to the retainer housing 32. The retainer housing 32 comprises a one piece molded plastic housing which is generally rectangular in shape and defines a generally rectangular central opening 170. The retainer housing 32 has top and bottom walls 172, 174 which define a first height adjacent its forward end 175 to receive the forward and intermediate portions 106, 104 of the connector body 34 and of a larger height adjacent its rearward end 176 for receiving the rearward portion 102 of the connector body 34. The top and bottom walls 172, 174 of the retainer housing 32 at its forward end 175 adjacent the juncture with its rearward end is slit at transverse spaced locations to provide a plurality of through slots 177. The retainer housing 32 also at its forward end 175 has an end wall 178 provided with a plurality of apertures 180 which are adapted to be aligned with the cavities 100 of the connector body 34 when the latter is connected thereto.

The retainer housing 32 at its top and bottom walls 172, 174 adjacent its rearward end is slotted or formed so as to define integral U-shaped latch members 182 which define through openings 184. In addition, the retainer member housing 32 adjacent its opposite sides has vertically upwardly and vertically downwardly extending ribs or flanges 188 which extend upwardly from the top and bottom surfaces 172, 174 to enable it to be slidably connected to the header housing 20, and in a manner to be hereinafter described.

Further, the retainer housing 32 includes a pair of laterally spaced, cantilevered latch arms 190 integral with the top wall 172 of the housing 32 at its rearward end by upwardly extending leg portions 192. The latch arms 140 have bevelled forward ends, as indicated by reference numeral 194, which terminate in upwardly extending barbs 195 having rearwardly facing surfaces 196. The arms 190 are disposed above the top surface 172 and are integrally connected together via a bridge 200 having a downwardly extending flange 202.

The connector body 34 is adapted to be connected to the retainer housing 32 by inserting the forward end 106 thereof into the opening 170 in the retainer housing 32. If all of the terminals 36 have been properly seated within the connector body 34, the intermediate portion 104 of the connector body 34 will be slidably received within the opening 170 of the retainer housing 32 and with the various tabs 130 thereof being slidable within the slots 177 in the top and bottom walls 172, 174 of the retainer housing 32. If, however, one or more of the terminals 36 is not properly seated such that the associated nib 128 is resting on one of the lands 140, the tab 130 of the associated wall portion 122 will be deflected outwardly and be in a position such that the connector body 34 cannot be slidably received within the opening 170 due to the engagement between the tab 130 and a rear end abutment surface 210 of the top or bottom walls 172 or 174 of the retainer housing because it will be out of position to be received within its associated slot 177. When this occurs, the operator will have to remove the connector body 34 and reposition the terminal 36 which was not properly seated.

When the connector body 34 is being connected to the retainer housing 32 (and assuming all the terminals 36 are properly seated) the tabs 108 will engage latches 182 and cause the latter to be deflected outwardly until the tabs 108 are aligned with the openings 184 of the tabs 182 whereupon the tabs 182 will return to their normal free state position and lock behind the tabs 108. This locks the connector body 34 to the retainer housing 32.

The retainer housing 32 is connectable to the header housing 20 by sliding the forward end thereof into the central opening 22 in a header housing portion 140 of the header housing 20. When this occurs, the ribs 188 will be received within the slots 56 in the header housing 20 along both sides of the housing portion 40 of the header housing 20. At the same time, the terminals 36 will be brought into position to engage the forward ends 28A of the pin terminals and to form a mating connection therewith to provide an electrical connection between the pin terminals 28 and the socket terminals 36. In addition, the latch arms 190 will have their barbs 194 engage the ramped barbs 62 on the header housing 20 and cause the barbs 194 to be deflected downwardly until the latch arms 190 are positioned such that the barbs 194 are located forwardly of the barb 62 whereupon, due to the inherent resiliency of the latch arms 190, they will return toward their normal free state position in which they are parallel to the retainer housing 32 and latch behind the barbs 62. This connects the retainer housing 34 to the header housing 20.

When the retainer housing 32 has been properly connected to the header housing 20, the wall portions 122 of the intermediate portion 104 of the connector housing 34 are located within the opening 22 of the housing 20 and the tabs 130 on the wall portions 142 are located adjacent the top and bottom walls defining the opening 22 in the housing 20. This serves as an additional lock for the terminals 36. The tabs 130 will engage the top or bottom wall defining the opening 22 of the housing 20 should they be deflected outwardly in response to forced rearward movement of a terminal 36, i.e., movement to the right of a terminal, as viewed in FIG. 3.

In addition to the above described connecting means between the connector housing 34 and retainer housing 32, a connector position assurance (CPA) 220 is preferably provided to ensure that the retainer housing 32 has been properly connected to the header housing 20. The connector position assurance 220 includes a one piece member having a forward projecting portion 222 and a pair of deflectable, cantilever supported side arms 224 having barbs 226. The connector position assurance is slidable on the top wall 172 of the retainer housing 32 and with the forward portion 222 being received beneath the bridge 200 between the latch arms 190. As the connector position assurance 220 is further moved from right to left, as viewed in FIG. 7, the arms 224 will be deflected toward each other as a result of the engagement between the ramped barbs 226 and the leg portions 192 until the ramp barbs 226 clear the leg portions 192 whereupon they will return to their normal free state position and lock the connector position assurance therebehind. The forward portion 222 of the connector position assurance 220 will freely slide beneath the flange 202 of the bridge 200 and this prevents disconnection between the retainer housing 32 and the header housing 20 unless the connector position assurance 220 is first manually removed, since the arms 190 cannot be deflected downwardly due to the engagement between the flange 202 and the forward portion 222 of the connector position assurance 220. If the retainer housing 34 and header housing 20 have not been properly secured together, the forward portion 222 of the connector position assurance will engage the flange 202 and be prevented from having its arms 224 latched behind the leg portions 192. This provides a visual assurance to make sure that the two housings have been properly connected together.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A header assembly for a printed circuit substrate comprising:

a header housing having a central through opening, a side opening extending normal to and communicating with said center opening and mounting means for mounting the housing to the circuit board, a connector subassembly connectable to said header housing and comprising a connector body having a plurality of axially extending cavities therethrough and a plurality of metal socket terminals disposed within said cavities, a pin terminal and carrier subassembly comprising a plastic, generally rectangularly shaped carrier strip having a plurality of openings extending therethrough and a plurality of pin terminals inserted through the openings in the carrier strip and retained in the strip so that their forward and rearward end portions extend outwardly from the carrier strip, one of said header housing and said carrier strip having a pair of rails and the other of said header housing and carrier strip having grooves therein for receiving said rails, said carrier strip being connectable to said header housing by sliding said carrier strip through said side opening and into the header housing so that said rails are received in said grooves whereby said pin terminals are located within said central through opening of said header housing, said socket terminals of said connector subassembly being connected to said forward end portions of said pin terminals by axially moving the connector subassembly into the central through opening of said header housing until it is connected to the header housing.

2. A header assembly for a printed circuit substrate comprising:

a header housing having a generally rectangularly central through opening, a side opening adjacent one end thereof which extends normal to an communicates with the central opening and mounting means for mounting the header housing to the circuit board, a pin terminal and carrier subassembly comprising a plastic, generally rectangularly shaped carrier strip having a plurality of openings extending therethrough and a plurality of pin terminals inserted through the openings in the carrier strip and retained in the carrier strip so that their forward and rearward end portions extend outwardly from the carrier strip, said header housing adjacent said one end thereof having spaced rails extending along its elongated sides and inwardly into the central opening and said carrier strip having oppositely facing grooves along its elongated sides for receiving said rails on said header housing, said preassembled pin terminal and carrier strip being connected to said header housing by sliding said carrier strip through said side opening into the header housing so that said rails are received within said grooves and until said carrier strip engages said header housing at its other end remote from said side opening so that said pin terminals are positioned within said central opening of said header housing, a connector subassembly comprising a connector body having a plurality of axially extending cavities therethrough and a plurality of metal socket terminals disposed within said cavities and which receive the forward ends of said pin terminals when the connector subassembly is inserted into the central opening in said header housing and connected to the latter.

3. A header assembly, as defined in claim 2, and wherein said mounting means on said header housing includes mounting feet located wholly beneath said central opening in said header housing.

4. A header assembly, as defined in claim 3, and wherein said mounting feet have threaded apertures for receiving a threaded fastener.

5. A header assembly, as defined in claim 2 or 3, and wherein said carrier strip has an interference fit with said rails of said header housing when slidably connected thereto.

6. A header assembly, as defined in claim 5, and wherein said header housing is a zinc die cast housing.

7. A header assembly for a printed circuit substrate comprising:

a header housing having a generally rectangularly shaped central through opening, and mounting means for mounting the header housing to the circuit board, a preassembled pin terminal and carrier subassembly comprising a plastic, generally rectangularly shaped carrier strip having a plurality of openings extending therethrough and a plurality of pin terminals inserted through the openings in the carrier strip and retained in the carrier strip so that their forward and rearward end portions extend outwardly from the carrier strips, said header housing and said carrier strip having cooperably engageable means for connecting said preassembled pin terminal and carrier strip assembly to the header housing to position said pin terminals within said central opening in said header housing, a connector subassembly comprising a retainer housing, a connector housing having a plurality of axially extending cavities therethrough and a plurality of metal socket terminals disposed within said cavities of the connector body, said cavities intermediate their ends being defined in part by split outer wall portions on said connector body, said wall portions being radially flexible and having radially inwardly extending nibs and axially extending tabs located outwardly thereof, said terminals having axially spaced, radially extending, forward and rearward lands defining a recess therebetween, said socket terminals being connected to said connector body by inserting the socket terminals into said cavities and with the forward lands engaging said nibs and deflecting said wall portions and tabs radially outwardly until the forward lands clear the nibs whereupon said wall positions return to their normal position and lock the terminals in place, said retainer housing having an outer wall defining a central opening for slidably receiving the connector body therein and having a plurality of axially extending slots in its outer wall for slidably receiving said tabs on said wall portions of said connector body when the latter is connected thereto, said tabs on said wall portions of said connector body engaging said retainer housing and preventing said connector body from being connected to the retainer housing if any of the terminals are not properly locked in place by the nibs on said wall portions, first cooperable means on said retainer housing and said connector body for latching said connector body to said retainer housing, said retainer housing housing being slidably connected to said header housing by inserting the outer wall of the retainer housing into the central opening of said header housing from its end remote from said pin terminal and carrier strip and with the socket terminals of the connector body slidably engaging the pin terminals carried by the carrier strip, and second cooperable means on said header housing and said retainer housing for latching said connector subassembly to said header housing.

8. A header assembly, as defined in claim 7, and wherein said first cooperable means comprises pairs of transversely spaced latch arms on said retainer housing at its top and bottom sides and pairs of transversely spaced transversely spaced ramps on the connector body at its top and bottom sides whereby said connector body cannot pivotally move relative to the retainer housing.

9. A header assembly, as defined in claim 7, and wherein said cooperably engageable means on said header housing and said carrier strip are respectively a pair of spaced rails and a pair of grooves for receiving said rails.

10. A header assembly, as defined in claim 9, and wherein said header housing has a side opening at one end which communicates with said central opening and wherein said carrier strip is slidably connected to the rails of the header by sliding said carrier strip through said side opening and with the carrier strip slidably engaging said rails on said header housing with an interference fit.

* * * * *